United States Patent [19]

Murata et al.

[11] Patent Number: 4,718,290

[45] Date of Patent: Jan. 12, 1988

[54] PINION SHIFT STARTER FOR ENGINES

[75] Inventors: Nobuyoshi Murata, Miki; Kozo Watanabe, Ono, both of Japan

[73] Assignee: Kawasaki Jukogyo Kabushiki Kaisha, Japan

[21] Appl. No.: 879,957

[22] Filed: Jun. 30, 1986

[30] Foreign Application Priority Data

Jul. 19, 1985 [JP] Japan ..... 60-160967

[51] Int. Cl.[4] ..... F02N 15/06

[52] U.S. Cl. ..... 74/7 A; 74/7 R; 74/572; 310/62; 310/88

[58] Field of Search ..... 74/6, 7 R, 7 A, 7 C, 74/572; 290/48; 310/62, 88

[56] References Cited

U.S. PATENT DOCUMENTS

| | | | |
|---|---|---|---|
| 3,955,427 | 5/1976 | Squires | 74/7 A X |
| 4,104,926 | 8/1978 | Wilson | 74/7 R X |
| 4,206,656 | 6/1980 | Hollyoak | 74/7 A X |

FOREIGN PATENT DOCUMENTS 58-15659 3/1983 Japan .

*Primary Examiner*—Allan D. Hermann
*Attorney, Agent, or Firm*—Eric P. Schellin

[57] ABSTRACT

A pinion shaft starter for internal combustion engines having its pinion coupled to the shaft of the starter motor through an overruning clutch is disclosed in which a dividing wall member is mounted to define in the starter housing a first chamber located on the side of the pinion and a second chamber on the side of the starter motor, with a dust discharging vent formed in the first chamber, at a circumferential point externally of the wall member. The wall member is provided to encircle the external circumference of the overrunning clutch regardless of the position of the clutch which is axially moved by the solenoid switch to bring the pinion into or out of engagement with the ring gear on the flywheel through an opening formed in the starter housing. To insure sealing between the outside clutch circumference and wall member, an annular ring is provided along the inside periphery of the wall member. Thus, the foreign matter contained within the air flow from the cooling fan mounted adjacent to the flywheel entering the starter housing through the opening is allowed to cause the motion of the vortexes only in the first chamber and eventually let out through the vent, without every approaching the dividing wall member, so that the starter motor below the wall member is protected against dust and debris deposit.

3 Claims, 3 Drawing Figures

PINION SHIFT STARTER FOR ENGINES

BACKGROUND OF THE INVENTION (1.) Field of the Invention

The present invention relates to a pinion shift starter for internal combustion engines in which the torque from the starter motor shaft is transmitted to the flywheel ring gear through a reciprocable pinion which is moved forward into engagement with the flywheel ring gear by an engaging sleeve which is coupled to the motor shaft by a solenoid switch.

(2.) Description of the Prior Art

There have been developed various types of starters for small general purpose internal combustion engines, such as Bendix type starters and pinion shift starters as disclosed in Japanese laid-open patent specification No. 58-15659.

In a Bendix type starter, the coupling means pushes the pinion into engagement with the ring gear on the flywheel while it, driven by the starter, rotates in inertia, so that the starter can turn the engine. When the engine begins to rotate faster than the starter, the coupling means, urged by the return spring, is pulled back to home position disengaging the pinion from the flywheel ring gear. A serious problem with those Bendix type starters is that disengagement between the starter and engine, which is effected when the difference in speed of their rotation has reached a certain point, can take place before the engine is started to the sufficient speed for firing. Another problem is the great noise the starters develop when the pinion is brought into engagement with the flywheel ring gear since the engagement takes place with the pinion in rotation.

In a pinion shift starter, a magnetic field set up by the solenoid when the starter switch is pressed brings the coupling sleeve into engagement with the starter motor shaft, and pushes the coupling sleeve against the pinion which, in turns, moves into engagement with the ring gear on the flywheel. As long as the solenoid is held down in energized position, disengagement between the starter motor and engine will not take place so that the latter can be started until firing.

However, in those conventional pinion shift starters, since the designs require the starter motor and associated devices, such as a solenoid switch, to be installed in compact space at the end of the crankcase on the opposite side of the crankcase end wall, a hole has to be drilled in the crankcase end wall to permit the pinion to enter the crankcase for engagement with the ring gear on the flywheel. One of the problems with the prior art starters of this type is that this hole has given unwanted freedom for a foreign matter such as dust and debris to enter the chamber in which the starter is housed.

Various device have so far been proposed to eliminate this problem. One such a device is a dust hood adapted to enclose the flywheel, as illustrated in FIG. 2, so as to prevent entrance of the foreign matter into the starter housing. Another proposed technique is the seal type pinion in which the pinion shaft has an enlarged circumference portion enough to close the diameter of the hole, as shown in FIG. 3.

Referring to FIG. 2, the dust food 25 is provided to encircle the flywheel 2 with the cooling fan 2 and has a hole 25A located just opposite the pinion 14 so that the pinion can enter the crankcase for engagement with the flywheel ring gear. This food 25 is very effective to prevent entrance of the foreign matter such as dust and debris into the starter housing 7.

However, because of the location of the cooling fan 2 in the vicinity of the hole 25A, dust through the fan 2 is allowed to enter the space 26, and eventually into the starter housing 7, when the fan is in operation.

This disadvantage would be further aggravated in a vertical crankshaft internal combustion engine in which the hole 25A stands at the bottom of the crankcase end wall allowing dust and dirt through the cooling fan 2 to fall to deposit in the starter housing 7.

Furthermore, since the hood 25 has to be mounted to completely enclose the flywheel 3, the overall crankcase construction becomes complicated with a consequent increase in production costs. In addition, in order to minimize the entrance of foreign matter through the cooling fan 2, the hole 25A has to have as small a diameter as possible and has to be located as near the flywheel ring gear. Since the cooling fan 2, in turn, is required to have a large capacity so that its front diameter consequently becomes large. Thus, the flywheel 3 has a stepped configuration, as illustrated in the drawing, with a large diameter top portion, so that the air from the fan 2 is not directly oriented to the hole 25A. However, this design makes the fan cover 5 to extend a great distance above the flywheel 3, which makes it impossible to have a desired small engine construction.

In addition, the space L defined around the flywheel 3 below its top portion becomes greater as the axial length of the flywheel 3 gets larger, forming, in some instances, a large pool for a great amount of the foreign matter to deposit so that considerable labor and time are required to remove the collected foreign matter there.

The seal type pinion, as illustrated in FIG. 3, does not require any dust hood enclosing the flywheel such as stated above. A bearing metal 27 is inserted in fixed position in the bore in the starter housing 7 through which the pinion 14 is reciprocated into or out of engagement with the flywheel ring gear. The pinion 14, in turn, has an enlarged neck portion 14A whose external diameter is substantially the same as the inside diameter of the bearing metal 27. Further, the neck portion 14A is formed to have a long axial length enough to keep the pinion shaft in constant contact at the external surface of the neck portion 14A with the bearing metal 27 while the pinion 14 is moved on the forward or backward stroke relative to the flywheel 3 ring gear. Since the bore is always closed in this manner, entrance of foreign matter into the starter motor 10 from inside the fan cover 5 is prevented.

However, this design puts to the pinion shaft an additional length for the neck portion 14A, which offers the disadvantage that the overall starter construction has an attendant increase in the axial length. Thus, these seal type pinion not only fails to meet the need for compact construction, desired for small general purpose engines, but also might pose a rigidity problem in the structure since the added length of the starter housing makes the crankcase have an increased overhang or downwardly extending distance as measured from the starter motor lower end to the attaching point, largely indicated at 8, of the starter housing to the crankcase 1.

It is these problems that gave rise to the present invention.

SUMMARY OF THE INVENTION

It is therefore a primary object of the present invention to provide a pinion shift starter which has an effective means to minimize the entrance of outside foreign matter into the starter motor.

It is another object of the present invention to provide such a starter in which said means is of a very simple construction and can be built without much increasing the assembling cost of the starter.

It is an additional object of the present invention to provide such a starter which permits the removal of dust deposits inside the starter housing in an easy manner.

It is a further object of the present invention to provide such a starter of such design that enables the engine to be built in a compact construction.

To achieve the above and other objects, the starter has a dual chamber defined in the starter housing on the flywheel side, divided by a dividing wall into a first space adjacent to the pinion and a second space formed between the first space and the starter motor. The dividing wall is mounted to closely encircle the overrunning clutch interconnected between the pinion and starter motor shaft and has a dust discharge vent formed in the wall of the first space. The dust forced with the air from the cooling fan into the starter housing is allowed to cause the motion of the vortexes in the first space and eventually deflect to exit the vent, without further entering the second space in which atmospheric pressure is maintained.

These and other objects, features and advantages of the present invention will be more fully understood and appreciated from the following description of specific embodiments taken together with the accompanying drawings.

DETAILED DESCRIPTION OF PREFERRED EMBODIMENTS

The preferred embodiment of the present invention will be described in detail in conjunction with the accompanying drawings.

Figure 1:
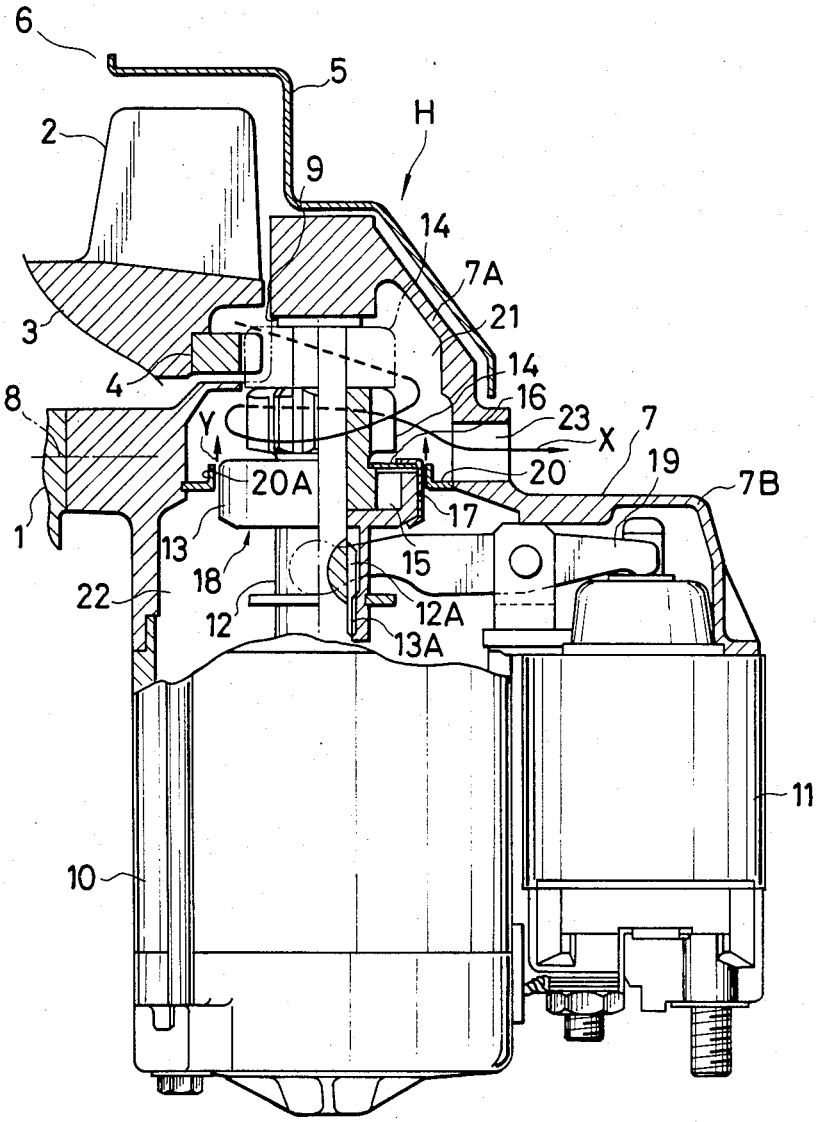
FIG. 1 is a cross sectional view of a preferred embodiment of the pinion shift starter constructed in accordance with the present invention.

FIG. 1 is a preferred embodiment of the starter according to this invention installed in a small general purpose internal combustion engine having a vertical crankcase 1 with a crankshaft (not shown) mounted in vertical position.

To a lower end of the crankshaft (at the upper portion of the drawing) is secured a flywheel 3 which, in turn, is made integral with a cooling fan 2. A ring gear 4 is formed about the periphery of the flywheel 3.

The fan 2 is shrouded in a fan cover 5 having an air inlet 6 opened at an external end thereof in the crankcase 1.

A starter housing 7 is provided attached to the crankcase 1 at a mounting point, largely indicated at 8, thereof on the side of the flywheel 3.

The starter housing 7 consists of an upper chamber 7A and a lower chamber 7B made integral with the upper chamber 7A.

The lower chamber 7B has its bottom opened whereas the upper chamber 7A is closed at its top except for an access hole 9 as will later be described.

In the opened bottom of the lower chamber 7B is mounted a starter motor 10 with a solenoid switch 11 located on one side of the motor. The skirt of the lower chamber 7B is affixed to the upper periphery of the solenoid switch 11 in such a manner that the starter motor 10, together with the solenoid switch 11, is enclosed airtight in the lower chamber 7B.

The starter motor 10 is installed in a vertical position, with its output shaft 12 extending in upward direction toward the crankcase, and slidably mounted in position for axialy bodily movement relative to the flywheel 3. About the output shaft 12 is formed a male helical spline 12A threaded spirally in a direction opposite to the rotation of the starter motor 10 in operation.

To the upper end of the output shaft 12 is connected an engaging sleeve 13. A female helical spline 13A is formed in a lower inside surface of the sleeve 13 for engagement with the helical spline 12A, when the output shaft 12 turned, the sleeve 13 is moved upward. Also, the sleeve 13 is coupled to a pinion 14 through a plurality of clutch rollers 15 provided in the sleeve 13.

The sleeve 13, the pinion 14 and the clutch rollers 15 constitute in combination with a pair of first and second retainers 16 and 17 an overrunning clutch 18. A shifting fork lever 19 is provided mounted on a fulcrum on the solenoid switch 11. One end (on the right of the drawing) of the shifting fork lever 19 is secured to the solenoid switch 11 while its other end is affixed to the sleeve 13 of the starter motor 10.

With this arrangement, when the starter switch is turned on, the solenoid switch 11, together with the starter motor 10, is energized pulling the right end of the shifting fork lever 19 so that the sleeve 13 is moved upward briging the male helical spline 12A in spiral movement into engagement with the female helical spline 13A in the sleeve 13. This causes the overrunning clutch 18 to also move upward bringing the pinion 14 into engagement with the ring gear 4, at an advanced position where the pinion is depicted in double-dot chain line in the drawing, where the rotation of the starter motor 10 is transmitted to the flywheel 3 through the pinion 14.

Once the engine has been started to proper firing, the solenoid switch 11 is automatically turned off in any conventionally known technique, so that the shifting fork lever 19 is released from the pulling grip at its right end. When the rotational speed of the flywheel 3 has exceeded that of the output shaft 12 of the starter motor 10, the pinion 14 falls out of engagement with the ring gear 4 on the flywheel 3 as a result of inertia in the overrunning clutch 18.

About the sleeve 13 of the overrunning clutch 18 is mounted a dividing wall 20 to divide the starter housing 7 into an upper room 21 and a lower room 22. The dividing wall 20 is provided to closely enclose the sleeve 13 with minimum air gap between the inside surface of the wall and the outside surface of sleeve, just enough to allow the sleeve 13 to reciprocate through the central hole of the dividing wall 20. Also, the dividing wall 20 is located in the housing 7 such that its inside surface is always in contact with the outside surface of sleeve regardless of the position of the overrunning clutch 18.

Also, in the wall of the upper room 21 are formed dust discharge holes 23 at two circumferential locations both externally of the dividing wall 20 as viewed in the direction of H.

The dividing wall 20 may be a plate separately affixed to the inside surface of the starter housing 7 at a position about the sleeve 13 of the overrunning clutch 18.

In a more preferred embodiment, the dividing wall 20 has an annular ring 20A formed in its inside periphery to insure enhanced sealing with the outside sleeve surface.

As stated above, since the sleeve 13 of the overrunning clutch 18 is closely encircled by the dividing wall 20, which defining the upper and lower rooms 21 and 22 in the housing 7, and the dust discharge holes 23 are located in upper room 21 externally of the dividing wall 20, the air from the cooling fan 2 entering the starter housing 7 through the access hole 9 is allowed to cause the motion of the vortexes, as indicated by the arrow X, within the upper chamber and let out through the dust discharging holes 23. Thus, the foreign matter carried within the air are circulated in centrifugal effect in the upper room 21, without approaching the dividing wall 20, and dispelled in a drift through the dust discharge holes 23. This drift occurring in the upper room 21 also causes an effect, known as the ejector effect, of setting up a forced air flow in the direction of the arrow Y through the gap between the inside diameter of the dividing wall 20 and overrunning clutch sleeve 13, building up a pressure condition substantially atmospheric pressure inside the lower room 22, which further works against approaching of the dust and dirt containing in the air flow to the dividing wall 20.

Figure 2:
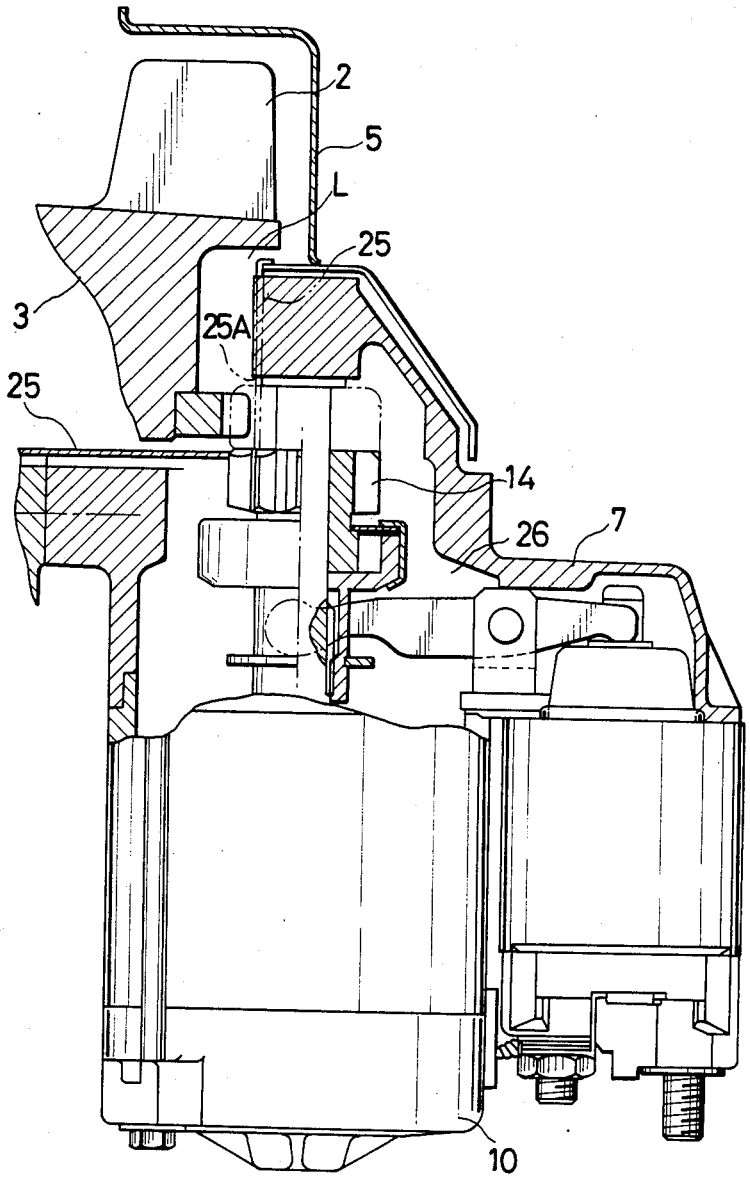
FIG. 2 PRIOR ART
FIG. 2 is a cross sectional view of an example of the conventional pinion shift starter employing a dust hood.
Figure 3:
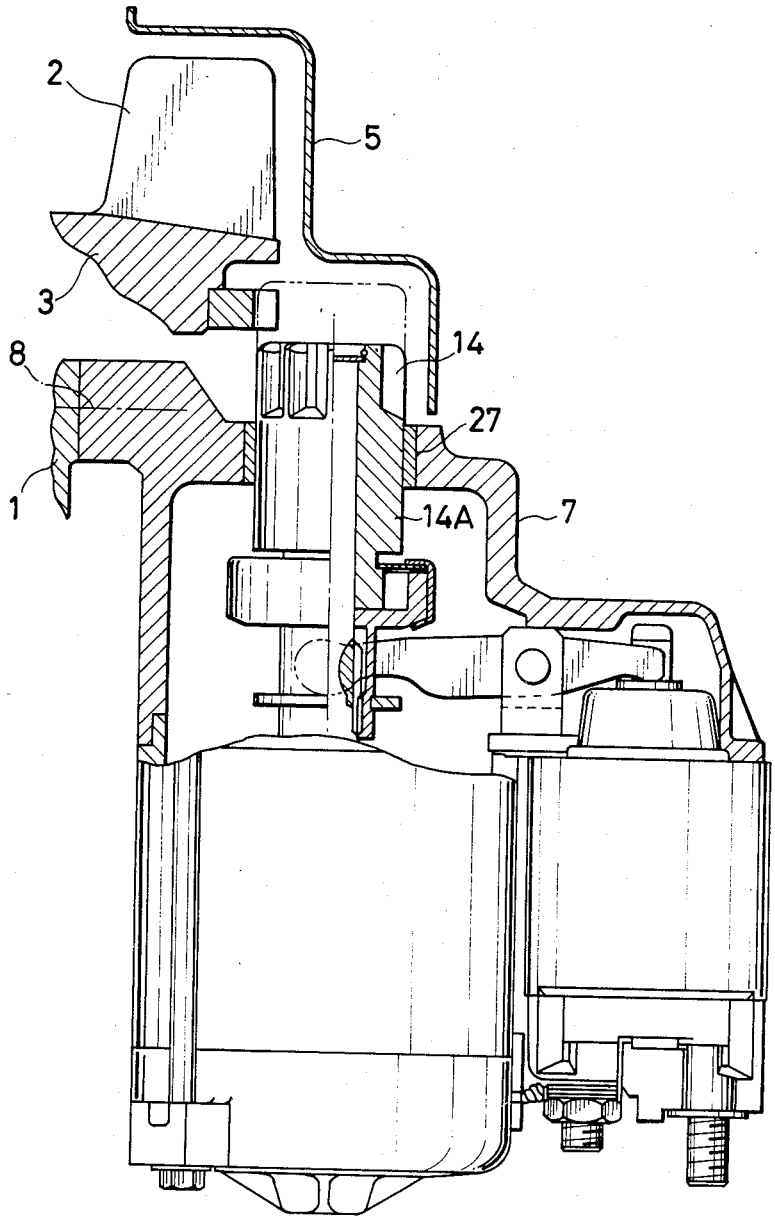
FIG. 3 PRIOR ART
FIG. 3 is a cross sectional view of an example of the conventional seal type pinion shift starter.

The dust prevention structure of the pinion shift starter according to the present invention not only eliminates the problems associated with the irregular configuration of the flywheel 3 plus the problems caused by the prior art dust hood as shown in FIG. 2. The dust prevention structure of the present invention makes it possible to produce a smaller engine without an increase in production costs due to increased complexity of design.

Furthermore, since the conventional dust hood 25 can be eliminated, there is left ample space for a flywheel 3 of adequate size so that the cooling fan 2 can be mounted in a location far inside the crankcase 1 making it possible to have a compact overall construction of engine. In addition, the cooling fan 2 stands more internally of the outside circumference of the flywheel 3, the gap between the flywheel and fan cover 5 becomes narrower to minimize the passage of foreign matter through the gap. As a consequence, efforts to remove the deposited debris and dust inside are considerably minimized.

In addition, the central hole in the dividing wall is sealed by the axial length of the overrunning clutch sleeve portion, without using the slidable sealing neck of those conventional pinions 14, so that the overhand of the crankcase, as measured from the mounting point 8 to the starter housing lower end, is minimized. This also contributes to minituarizing the overall engine build and increasing rigidity.

Furthermore, since the dividing wall 20 has the ring 20A, it can prevent falling of the dust that might deposit on the dividing wall 20 into the lower room 22 as a result of vibration as when the engine is stopped.

In construction, the starter housing 7 may be formed with an integral dividing wall 20 in single shaping operation. However, more preferably, the dividing wall 20 is formed as a separate plate and affixed to the housing 7 in a later assembling state, which can make more convenient the molding of a starter housing with divided upper and lower rooms 21 and 22.

The starter housing may be formed integrally with the crankcase 1.

The upper chamber 7A of the starter housing 7 may be build as a separate portion from the lower chamber 7B.

The ring 20A formed in the dividing wall is, in this particular embodiment, of a straight vertical cross section. However, it may be triangular in cross section.

In addition, the dividing wall 20 may be provided to protrude toward the outside overrunning clutch circumference. However, this arrangement may not be so beneficial as the preferred embodiment of FIG. 1, since the foreign matter carried within the air from the fan is apt to enter the lower room 22 of the housing 7 because of the drift within the upper room tending to have a faster velocity at its outside edge.

It will be easily appreciated that the pinion shift starter according to the present invention can effectively prevent entrance of the foreign matter contained in the cooling fan air flow into the starter housing, constructed at a low cost because of the relative simplicity of construction, and would facilitate the labor of removing deposited dust and dirt in the housing. Also, the overall structure of the starter can make it possible to build an engine in compact construction.

The embodiment described above and drawing are given only by way of illustration and modifications and changes will occur to those skilled in the art, without departing the spirit of the present invention. Therefore, this invention should be limited only by the scope of the appended claims.

What is claimed is:

1. In a pinion shift starter for internal combustion engines, said starter including a starter housing means attached to a crankcase of said internal combustion engine, said crankcase having a rotatable crankshaft and having a portion thereof extending outside of said crankcase, said portion termination in a flywheel, said flywheel having fan means operatively thereon adapted and constructed to drive air towards said crankcase when said flywheel rotates, said flywheel having a ring gear about its circumference, an electric starter motor positioned in said starter housing having a rotor, a solenoid in said starter housing mounted adjacent said starter motor, and overrunning clutch means operatively connected to said rotor, a pinion, said clutch means adapted and constructed to rotate said pinion when said starter is energized, means operatively connected to said solenoid to move said pinion into engagement with said ring gear when said solenoid is energized, the improvement comprising wall means in said starter housing to define a first chamber and a second chamber, the pinion being located in said first chamber, the starter and the solenoid being in said second chamber, said wall means having an opening means adapted and constructed to sealing embrace said overrunning clutch means extending therethrough, said first chamber of said starter housing has at least one opening whereby dirt may be discharged therethrough externally of the starter housing under the aegis of air currents created when said fan means on said flywheel rotates.

2. The apparatus of claim 1 wherein the opening means of said wall means includes a flange adapted and constructed to inhibit the passage of dirt in the direction of the said second chamber due to vibrations engendered by said internal combustion engine.

3. The apparatus of claim 2 wherein the at least one opening is positioned at substantially the furthest from said fan.

* * * * *